US011127543B2

(12) United States Patent
Inagaki

(10) Patent No.: US 11,127,543 B2
(45) Date of Patent: Sep. 21, 2021

(54) BUTTON ASSEMBLY GOVERNED BY A RESTRICTOR MEMBER

(71) Applicant: Sateco AG, Nänikon (CH)

(72) Inventor: Shuji Inagaki, Tokyo (JP)

(73) Assignee: Sateco AG, Nänikon (CH)

( * ) Notice: Subject to any disclaimer, the term of this patent is extended or adjusted under 35 U.S.C. 154(b) by 0 days.

(21) Appl. No.: 16/632,235

(22) PCT Filed: Sep. 8, 2017

(86) PCT No.: PCT/IB2017/055421
§ 371 (c)(1),
(2) Date: Jan. 17, 2020

(87) PCT Pub. No.: WO2019/048909
PCT Pub. Date: Mar. 14, 2019

(65) Prior Publication Data

US 2020/0176201 A1 Jun. 4, 2020

(51) Int. Cl.
*H01H 13/14* (2006.01)
*H01H 13/20* (2006.01)
*H01H 13/50* (2006.01)

(52) U.S. Cl.
CPC ..... *H01H 13/14* (2013.01); *H01H 13/20* (2013.01); *H01H 13/50* (2013.01); *H01H 2233/07* (2013.01)

(58) Field of Classification Search
CPC ..... H01H 13/14; H01H 13/48; H01H 13/78; H01H 13/84; H01H 2215/004;
(Continued)

(56) References Cited

U.S. PATENT DOCUMENTS 4,289,943 A * 9/1981 Sado ..... H01H 13/702 200/513
4,952,761 A * 8/1990 Viebrantz ..... H01H 13/702 200/43.01
(Continued)

FOREIGN PATENT DOCUMENTS

CN 2266787 Y 11/1997
CN 201196916 Y 2/2009
(Continued)

OTHER PUBLICATIONS

International Search Report and Written Opinion for PCT/IB2017/055421 dated Jun. 5, 2018, 13 pages.

*Primary Examiner* — Vanessa Girardi
(74) *Attorney, Agent, or Firm* — Blank Rome LLP

(57) ABSTRACT

According to the present invention there is provided a button assembly, comprising, a platform having at least two electrodes; a dome member which comprises electrically conductive material, wherein the dome member is electrically connected to at least one of said at least two electrodes, and the dome is arranged so that at least a portion of the dome member overlays at least one other of the at least two electrodes, so that when the dome member is selectively collapsed inwardly by the application of force, the dome member will electrically contact said at least one other of the at least two electrodes, so that in its collapse state the dome member electrically connects the at least one of said at least two electrodes with the at least one other of the at least two electrodes; an interface member which comprises, (a) a compression member which is attached to the dome member at a position which overlays said at least one other of the at least two electrodes; (b) a restrictor member which is configured such that it projects towards the platform and the distance between the platform and the restrictor member is less than the distance between said at least one other of the
(Continued)

at least two electrodes and portion of the dome which overlays at least one other of the at least two electrodes, and (c) at least one elastic member which connects the restrictor member and the compression member.

17 Claims, 11 Drawing Sheets

(58) Field of Classification Search
CPC ..... H01H 2215/036; H01H 2215/018; H01H 2215/016; H01H 2221/044; H01H 2221/062; H01H 2221/064; H01H 2227/0261; H01H 2227/034
See application file for complete search history.

(56) References Cited

U.S. PATENT DOCUMENTS 6,107,586 A * 8/2000 Takeuchi ..... H01H 13/12 200/520
6,303,887 B1 * 10/2001 Ando ..... H01H 13/702 200/1 B
7,217,893 B1 5/2007 Huang et al.
8,129,643 B2 3/2012 Anzai et al.
10,373,775 B2 8/2019 Ito et al.
10,439,326 B2 10/2019 Yang
2013/0114199 A1 5/2013 Jung

FOREIGN PATENT DOCUMENTS

CN 204045458 U 12/2014
CN 105518816 A 4/2016
JP H-03214521 A 9/1991
JP 2000123679 A 4/2000
JP 2002025386 A 1/2002
JP 2003308758 A 10/2003
JP 2004/063449 A 2/2004
JP 2005044739 A 2/2005
JP 2006/318653 A 11/2006
JP 2010/040431 A 2/2010
JP 2010/134576 A 6/2010
WO WO-2011007500 A1 1/2011
WO WO-2017/018097 A1 11/2017

* cited by examiner

BUTTON ASSEMBLY GOVERNED BY A RESTRICTOR MEMBER

RELATED APPLICATION

This application is a national phase of PCT/IB2017/055421, filed on Sep. 8, 2017. The entire content of this application is hereby incorporated by reference.

FIELD OF THE INVENTION

The present invention concerns button assembly, and in particular a button assembly which uses an elastic member to slow the speed at which a metal dome collapses inwardly upon the application of force, thereby reducing the noise which the elastic member makes when it is collapsed inwardly.

DESCRIPTION OF RELATED ART

Existing button assemblies typically comprise a dome member composed of electrically conductive material. This dome member is arranged to be electrically connected to a first electrode (typically the dome member will be mounted on the first electrode so that the base of the dome member will be in physical and electrical contact with the first electrode). The centre region of the dome is typically aligned over a second electrode. As a result, when a pressing force is applied to the dome member to cause the dome member to collapse inwardly, the centre region of the dome will come into contact with the second electrode; in its collapsed state the dome member will electrically connect the first and second electrodes. Disadvantageously, when the pressing force is applied to the dome member the dome will tend to collapse inwardly under a fast snapping action; this fast, snapping, collapse inward motion generates a undesirable loud noise.

It is an aim of the present invention to mitigate or obviate at least some of the disadvantages associated with existing button assemblies.

BRIEF SUMMARY OF THE INVENTION

According to the invention, these aims are achieved by means of a button assembly, comprising, a platform having at least two electrodes; a dome member which comprises electrically conductive material, wherein the dome member is electrically connected to at least one of said at least two electrodes, and the dome is arranged so that at least a portion of the dome member overlays at least one other of the at least two electrodes, so that when the dome member is selectively collapsed inwardly by the application of force, the dome member will electrically contact said at least one other of the at least two electrodes, so that in its collapse state the dome member electrically connects the at least one of said at least two electrodes with the at least one other of the at least two electrodes; an interface member which comprises, (a) a compression member which is attached to the dome member at a position which overlays said at least one other of the at least two electrodes; (b) a restrictor member which is configured such that it projects towards the platform and the distance between the platform and the restrictor member is less than the distance between said at least one other of the at least two electrodes and portion of the dome which overlays at least one other of the at least two electrodes, and (c) at least one elastic member which connects the restrictor member and the compression member.

Preferably the platform is a printed circuit board (PCB).

The dome member may have an aperture defined therein and the restrictor member may comprise a block which extends through the aperture towards the platform.

The second electrode may be annular shaped.

The block may comprise a surface which faces the platform, and wherein said surface has a circular-shaped perimeter, a square-shaped perimeter, a rectangular-shaped perimeter, or an elliptical-shaped perimeter.

In an embodiment said surface has a circular-shaped perimeter, and the diameter of the circular-shaped perimeter is between 0.6 mm-3.0 mm.

The surface may be concave, or convex, or flat.

In an embodiment an electrical contact may be attached said surface.

In an embodiment a damper member is attached said surface.

The compression member may comprise two or more nodules which are located symmetrically with respect to one another; and wherein said two or more nodules are each attached to the portion of the dome member which overlays said at least one other of the at least two electrodes. Preferably the two or more nodules are each attached to the portion of the dome member which is adjacent a rim which defines said aperture at the centre of the dome member.

The compression member may comprise an annular rim. The annular rim is preferably attached to the portion of the dome member which overlays said at least one other of the at least two electrodes.

The dome member may comprise an apex. The dome member may be arranged so that the apex of dome member overlays at least a portion of the second electrode. In this embodiment the compressor member is preferably attached to the apex of the dome member.

The second electrode may be disk-shaped. Preferably in this embodiment the dome member is arranged so that an apex of dome member is aligned with the centre of the disk-shaped second electrode.

The restrictor member may comprise one or more pillar members.

The restrictor member may comprise at least two pillar members which are arranged symmetrically with respect to one another.

The restrictor member may comprise a single pillar member.

The compression member may comprise a block member which is attached to the apex of the dome member.

The dome member may comprise a quadrilateral base portion.

In one preferred embodiment the a button assembly, comprises, a platform having at least a first electrode and a second electrode, wherein the first and second electrodes are insulated from one another; an dome member which comprises electrically conductive material, wherein the dome member has an aperture defined therein at its centre, wherein the dome member is electrically connected to the first electrode, and a portion of the dome member which is adjacent the aperture overlays at least a portion of the second electrode, so that the dome member can be selectively collapsed inwardly by the application of force to bring the portion of the dome member which is adjacent the aperture into electrical contact with the second electrode, so that in its collapse state the dome member electrically connects the first electrode and a second electrode; an interface member which comprises, a compressor member which is attached to said portion of the dome member which is adjacent the aperture, a restrictor member which is arranged to project through said aperture in the dome member towards the platform, and wherein the distance between the platform and the restrictor member is less than the distance between the second electrode and said portion of the dome member which is adjacent the aperture, and at least one elastic member which connects the restrictor member and the compressor member.

In another preferred embodiment the button assembly, comprises, a platform having at least a first electrode and a second electrode, wherein the at least first and second electrodes are insulated from one another; an dome member which comprises electrically conductive material, wherein the dome member is electrically connected to the first electrode, and the dome member is arranged so that a centre portion of the dome member overlays at least a portion of the second electrode, so that the dome member can be selectively collapsed inwardly by the application of force to bring the centre portion of the dome member into electrical contact with the second electrode, so that in its collapse state the dome member electrically connects the first electrode and a second electrode; an interface member which comprises, a compressor member which is attached to the centre portion of the dome member, an restrictor member which projects towards the platform, and wherein the distance between the platform and the restrictor member is less than the distance between the second electrode and said centre portion of the dome member, and at least one elastic member which connects the restrictor member and the compressor member.

In an embodiment dome member which has an aperture defined therein at its centre, so the dome member has a truncated-dome shape. In another embodiment the dome member is without an aperture at its centre and so has an apex.

In an embodiment the dome member comprises a dome shaped portion having at least four arched cut-outs, so as to define at least four leg portions, wherein each of the at least four leg portions are arranged to be electrically connected to the first electrode.

The at least one elastic member preferably has a thickness "a" (measured in a direction perpendicular to the plane of the platform 3) within the range 0.15 mm-0.8 mm.

Preferably the restrictor member is arranged so that the distance 'b' between the restrictor member and the platform (measured in a direction perpendicular to the plane of the platform 3) is less than 3 mm. Most preferably the restrictor member is arranged so that the distance 'b' (measured in a direction perpendicular to the plane of the platform 3) between a surface the restrictor member which faces the platform, and the platform, is less than 3 mm.

Preferably the interface member is composed of a material having a hardness of between 40 shore A-70 shore A.

In an embodiment the first electrode may have an annular shape. In an embodiment the second electrode may have annual shape.

The compressor member may comprise one or more nodules. Each of the one or more nodules are attached to the dome member. Most preferably each of the one or more nodules are attached to the portion of the dome member which overlays the second electrode. Preferably the compressor member comprises at least two nodules. The at least two nodules are positioned symmetrically with respect to one another. The compressor member may comprise an annular member and the at least two nodules may be located systemically on said annular member.

The compressor member may comprise an annular member which comprises an annular rim which is attached to the dome member. Most preferably compressor member may comprise an annular member which comprises an annular rim which is attached to the portion of the dome member which overlays the second electrode.

The restrictor member may comprise a block member. The block member preferably comprises a first portion and a second portion. The block member may be configured to have an inverted T-shaped cross section.

The interface member may further comprises an anchoring portion, and wherein a flexible member connects the anchoring portion to the compressor member. Preferably the anchoring portion is fixed to the platform.

Preferably assembly further comprises a actuator member which is mounted on the interface member. The actuator member is attached to, or abuts, the compressor member. In one embodiment there is a gap between the restrictor member and the actuator member. In another embodiment the there is no gap between the restrictor member and the actuator member; in other words in another embodiment the actuator member is attached to, or abuts, the restrictor member.

In an embodiment the dome member comprises a dome shaped portion and quadrilateral base portion, wherein the dome shaped portion is attached to and extends from the quadrilateral base portion. In one embodiment the dome shaped portion has an aperture defined at its centre; in another embodiment the dome shaped portion comprises an apex. Preferably the dome member is arranged so that the quadrilateral base portion is mounted on the first electrode so that the quadrilateral base portion is physically and electrically connected to the first electrode.

In an embodiment the first electrode has an annular shape, and the second electrode is contained within an area defined by the annular shape of the first electrode.

In an embodiment the second electrode is disk-shaped.

In an embodiment the restrictor member comprises at least one pillar member.

In an embodiment the restrictor member comprises at least two pillar members which are positioned symmetrically with respect to one another.

In an embodiment the restrictor member comprises a single pillar member.

In yet a further embodiment the restrictor member comprises an annular member which is arranged around the compressor member.

In an embodiment the compressor member comprises a block having a first portion and a second portion. In an embodiment the first portion is a cylindrical portion and the second portion comprises a fustoconical portion. Preferably, the fustoconical portion is attached to the apex of the dome member.

BRIEF DESCRIPTION OF THE DRAWINGS

The hatchings shown in the drawings are only to better illustrate the various components and do not limit any of the components to a specific material or property. The invention will be better understood with the aid of the description of embodiments given by way of example only, and illustrated by the figures, in which:

FIG. 3*a* illustrates the button assembly prior to the application of force to the actuator member, and FIG. 3*b* illustrates the button assemble after force has been applied to the actuator member to cause the dome member to collapse inwardly;

DETAILED DESCRIPTION OF POSSIBLE EMBODIMENTS OF THE INVENTION

Figure 1:
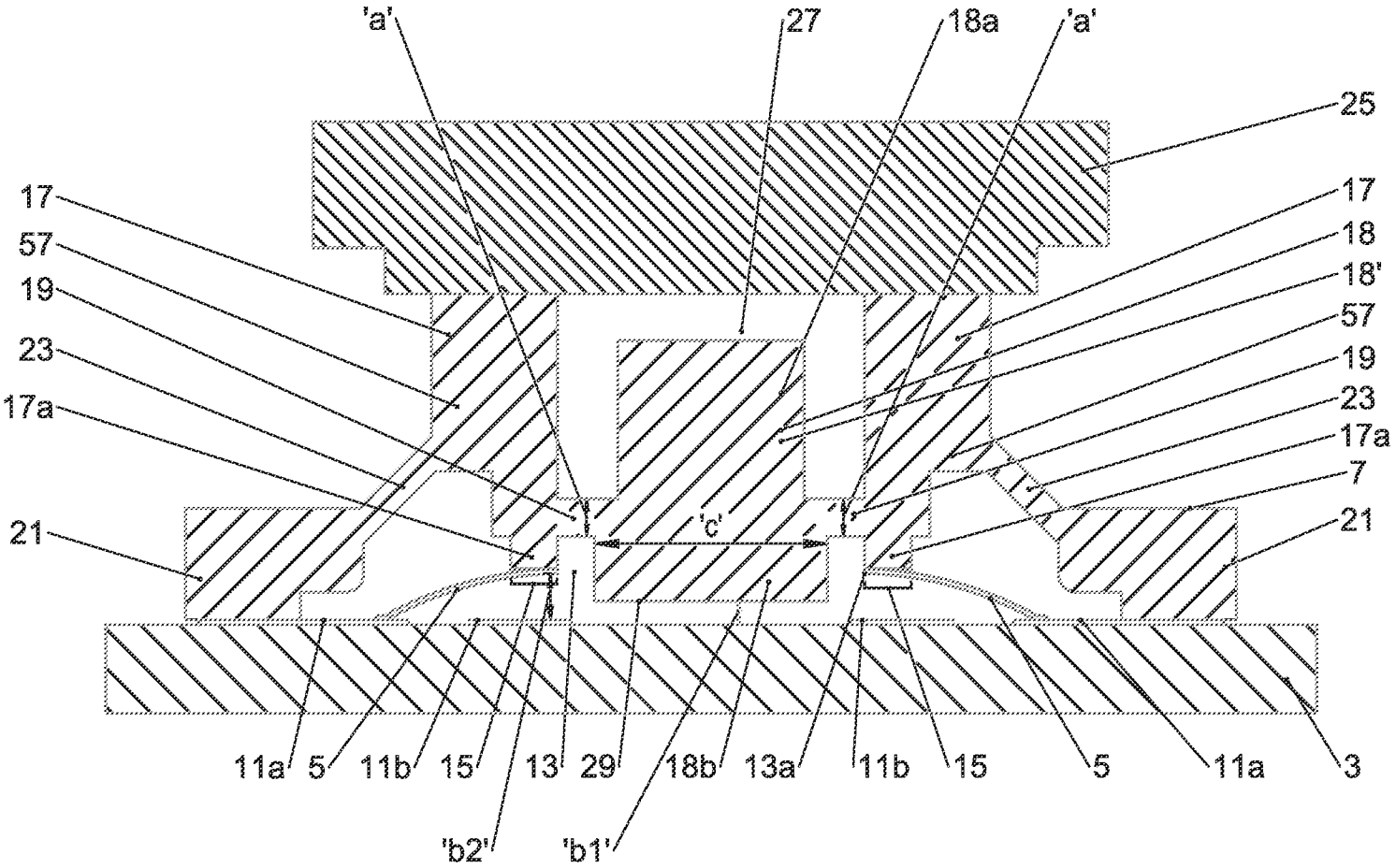
FIG. 1 shows a cross-sectional view of a button assembly according to one embodiment of the present invention.

In general the present invention relates to a button assembly, comprising: a platform having at least at least two electrodes; a dome member which comprises electrically conductive material, wherein the dome member is electrically connected to at least one of said at least two electrodes, and the dome is arranged so that at least a portion of the dome overlays at least at least a portion of one other of the at least two electrodes, so that when the dome member is selectively collapsed inwardly by the application of force, the dome member will electrically contact said at least one other of the at least two electrodes, so that in its collapse state the dome member electrically connects the at least one of said at least two electrodes with the at least one other of the at least two electrodes; and an interface member comprising, a compression member which is attached to the dome member at the portion which overlays said at least one other of the at least two electrodes or at least is attached proximate to or adjacent said portion, a restrictor member which is configured such that it projects towards the platform and the distance between the platform and the restrictor member is less than the distance between said at least one other of the at least two electrodes and said portion of the dome which overlays said at least one other of the at least two electrodes; and at least one elastic member which connects the restrictor member and the compression member. As will be described various implementations of the button assembly of the present invention are possible without departing from the scope of the invention:

FIG. 1 shows a cross-sectional view of a button assembly 1 according to one embodiment of the present invention.

A button assembly, comprises, a platform 3, a dome member 5, an interface member 7 and, optionally, an actuator member 9.

The platform 3 is preferably a printed circuit board (PCB). The platform is has at least a first electrode 11*a* and a second electrode 11*b*, wherein the first and second electrodes are insulated from one another. In this example each of the first electrode 11*a* and the second electrode 11*b* are annular shaped. However it should be understood that the first electrode 11*a* and the second electrode 11*b* may take any suitable shape of configuration.

The dome member 5 comprises electrically conductive material (e.g. stainless steel, copper, nickel, gold, nickel plated, and/or gold plated). The dome member 5 has an aperture 13 defined therein at its centre. In this embodiment since the dome member 5 has an aperture defined at its centre, the dome member has a truncated-dome-shape. In another embodiment, which will be described later, the dome member is configured to be dome-shaped. In one embodiment the dome member 5 comprises a truncated-dome-shaped portion which is attached to a quadrilateral base portion (i.e. a base which is quadrilateral shaped); in such an embodiment it is preferable that quadrilateral base portion is arranged to be electrically connected to the first electrode 11*a*; for example the dome member 5 could be arranged so that the quadrilateral base portion is mounted on the first electrode 11*a* so that the dome member 5 is physically and electrically contacts the first electrode 11*a*.

The dome member 5 is electrically connected to the first electrode 11*a*, and a portion 15 of the dome member 5 which is adjacent the aperture 13 (more specifically the portion 15 of the dome member 5 which is adjacent a rim 13*a* which defines the aperture 13) overlays at least a portion of the second electrode 11*b*, so that the dome member 5 can be selectively collapsed inwardly by the application of force to bring the portion 15 of the dome member which is adjacent the aperture 13 into electrical contact with the second electrode 11*b*. Accordingly, in its collapse state the dome member 5 electrically connects the first electrode 11*a* and a second electrode 11*b*. Most preferably when the dome member 5 electrically connects the first electrode 11*a* and a second electrode 11*b* this connection will close a circuit, and will result in some predefined actuation taking place. The button assembly 1 of the present invention will typically be used in an automotive application. Accordingly, in such an application, when the dome member 5 electrically connects the first electrode 11*a* and a second electrode 11*b* this connection will close a circuit, and will result in some predefined actuation taking place in the automobile, such as, the closing of an electrically controlled window in the automobile for example.

The interface member 7 comprises, a compression member 17, a restrictor member 18 and at least one elastic member 19.

The interface member 7 is composed of material having a Young's Modulus within the range 0.9 N/mm2-6.0 N/mm2, which is equivalent to a measured hardness of between 30° ShoreA-80° ShoreA. Most preferably the interface member 7 is composed of material having a hardness of 2.0 N/mm2 which is equivalent to a measured hardness 50° ShoreA. Most preferably the interface member 7 is composed of material having a hardness related to the required function. In this example the interface member 7 is composed of silicone material; however it will be understood that the interface member 7 could be composed of any other suitable elastomeric material. The interface member 7 may comprise, for example, silicon, fluorosilicone, Ethylene propylene diene monomer (EPDM), natural rubber, and/or a thermoplastic elastomer (TPE). In the example the interface member 7 is formed from a single moulded piece, thus the compression member 17, a restrictor member 18 and the at least one elastic member 19, are simply different parts of that single moulded piece. However, it should be understood that the interface member 7 is not limited to being a single moulded piece; the compression member 17, restrictor member 18 and the at least one elastic member 19, could be formed from different respective parts which are attached to one another using a suitable means of attachment.

The compression member 17 is attached to said portion 15 of the dome member 5 which is adjacent the aperture 13.

In this example the compression member 17 comprises an annular member 57 which comprises an annular rim 17*a* which is attached to the portion 15 of the dome member 5 which is adjacent the aperture 13; thus the annular rim will be attached to the portion 15 of the dome member 5 around the whole circumference of the aperture 13. Thus in this other embodiment, the shape of the annular rim 17*a* corresponds to the shape of the second electrode 11*b* i.e. both second electrode 11*b* and the annular rim 17*a* may be annular shaped.

It will be understood that the compression member 17 may take any suitable configuration. In yet another example the compression member 17 comprises one or more nodules. Importantly, the one or more nodules are attached to the portion 15 of the dome member 5 which is adjacent the aperture 13. In embodiments in which the compression member 17 comprises two or more nodules, preferably the two or more nodules are located symmetrically on the annular member 57. Preferably in embodiments in which the compression member 17 comprises two or more nodules, then the nodules are located symmetrically with respect to one another. For example if there are three nodules provided then the three nodules will be located 120° apart from one another; if there are four nodules provided then the four nodules will be located 90° apart from one another. Most preferably the compression member 17 comprises the annular member 57 and the nodules are located symmetrically on said annular member 57. In yet a further embodiment the compression member 17 may comprise a single nodule only on the annular member 57.

The restrictor member 18 is configured to project through said aperture 13 in the dome member 5, towards the platform 3. The distance 'b1' (measured in a direction perpendicular to the plane of the platform 3) between the platform 3 and the restrictor member 18 is less than the distance 'b2' (measured in a direction perpendicular to the plane of the platform 3) between the second electrode 11*b* and said portion 15 of the dome member 5 which is adjacent the aperture 13. Preferably the restrictor member 18 is arranged such that the distance 'b1' (measured in a direction perpendicular to the plane of the platform 3) between the platform 3 and the restrictor member 18 is less than 0.5 mm. Most preferably the restrictor member 18 is arranged such that the distance 'b1' is 0.15 mm. Preferably the dome member 5 is configured such that the distance 'b2' (measured in a direction perpendicular to the plane of the platform 3) between the second electrode 11*b* and said portion 15 of the dome member 5 which is adjacent the aperture 13 is within the range 0-1.0 mm. Most preferably the dome member 5 is configured such that the distance 'b2' is 0.3 mm.

Most preferably the restrictor member 18 is arranged such that the distance 'b1' (measured in a direction perpendicular to the plane of the platform 3) between the platform 3 and the restrictor member 18 is within the range 0.05 mm-0.5 mm; and the dome member 5 is configured such that the distance 'b2' (measured in a direction perpendicular to the plane of the platform 3) between the second electrode 11*b* and said portion 15 of the dome member 5 which is adjacent the aperture 13 is within the range 0.1 mm-0.5 mm.

It will be understood that the restrictor member 18 may take any suitable configuration. In this example the restrictor member 18 comprises a block member 18' having a first portion 18*a* and a second portion 18*b*. The first portion 18*a* comprises a first cylindrical portion 18*a* which extends, from the level where the elastic member 19 connects to the restrictor member, away from the platform 3; and the second portion 18*b* comprises a second cylindrical portion 18*b* which extends, from the level where the elastic member 19 connects to the restrictor member, towards the platform 3. The diameter of the second cylindrical portion 18*b* is larger than the diameter of the first cylindrical portion 18*a*; accordingly in this embodiment the restrictor member 18 has cross section which has an inverted T-shape. Preferably the diameter of the second cylindrical portion 18*b* is within the range 0.6 mm-3.0 mm. Preferably the diameter of the first cylindrical portion 18*a* is between 1.0 mm-3.5 mm. Most preferably the diameter of the second cylindrical portion 18*b* is 2.0 mm and the diameter of the first cylindrical portion 18*a* is 1.5 mm It should be understood that the present invention is not limited to requiring the restrictor member 18 to comprise a block member 18' having a first cylindrical portion 18*a* and second cylindrical portion 18*b*.

The second portion 18*b* comprises a surface 29 which faces the platform 3. It should be understood that in the present application, most preferably, the distance 'b1' (measured in a direction perpendicular to the plane of the platform 3) is the distance between the platform 3 and the surface 29 of the restrictor member 18 which is facing the platform 3.

The shape of the surface 29 will influence the sound made when the dome member 5 collapses inwardly to bring the portion 15 of the dome member which is adjacent the aperture 13 into electrical contact with the second electrode 11*b*. Different shapes of the surface 29 will provide different sounds when the dome member 5 collapses inwardly. In this example the second portion 18*b* is defined by the second cylindrical portion 18*b* the surface 29 will have a circular shape (most preferably the surface has a circular-shaped perimeter, and the diameter of the circular-shaped perimeter is within the range 0.6 mm-3.0 mm). However it will be understood that the second portion 18*b* may be provided with any suitable shape so as to achieve any suitable shape for the surface 29. Accordingly, the second portion 18*b* may take any suitable shape or form: for example the second portion 18*b* may be cube-shaped resulting in the surface 29 being square shaped (i.e. the perimeter of the surface 29 being square shaped); the second portion 18*b* may be cuboid-shaped resulting in the surface 29 being rectangular or square shaped (i.e. the perimeter of the surface 29 being rectangular or square shaped); the second portion 18*b* may be frustoconical-shaped or cylindrical-shaped, resulting in the surface 29 being circular shaped (i.e. the perimeter of the surface 29 being circular shaped); in yet another example the second portion 18*b* may be in a form having opposing elliptical-shaped surfaces resulting in the surface 29 being elliptical shaped (i.e. the perimeter of the surface 29 being elliptical shaped), for example the second portion 18*b* may be substantially cylindrical-shape having opposing elliptical-shaped surfaces, resulting in the surface 29 being elliptical shaped. Likewise it should be understood that the first portion 18*a* may take any suitable shape or form; for example the first portion 18*a* may be cube-shaped, cuboid-shaped, frustoconical-shaped; may be a form having opposing elliptical-shaped surfaces such as a substantially cylindrical-shape having opposing elliptical-shaped surfaces.

As mentioned the interface member 7 comprises at least one elastic member 19. In this example interface member 7 comprises a single annular-shaped elastic member 19. The elastic member 19 connects the restrictor member 18 and the compression member 17. Thus the elastic member 19 is interposed between the restrictor member 18 and the compression member 17. Specifically, in this example the elastic member 19 connects to the restrictor member 18 adjacent the interface between the first cylindrical portion 18*a* and second cylindrical portion 18*b*; the elastic member 19 connects to the annular member 57 of the compression member 17, at a position which is above the plane on which the two nodules 17*a*,17*b* lay.

Since the elastic member 19 is elastic, it can stretch to allow the restrictor member 18 and the compression member 17 to be moved with respect to one another.

The elastic member 19 preferably has a thickness "a" (measured in a direction perpendicular to the plane of the platform 3) within the range 0.15 mm-0.8 mm. Most preferably elastic member 19 has a thickness "a" (measured in a direction perpendicular to the plane of the platform 3) of 0.4 mm.

The interface member 7 is shown to further comprise an anchoring portion 21. The anchoring portion 21 is fixed, directly or indirectly, to the platform 3. Specifically, in this example the anchoring portion 21 is fixed to first electrode 11*a* on the platform 3, so that anchoring portion 21 is fixed indirectly to the platform 3. A flexible member 23 connects the anchoring portion 21 to the compression member 17. The flexible member 23 is configured so as to allow the compression member 17 to be moved with respect to the anchoring portion 21; specifically when a pressing force is applied to the compression member 17 the anchoring portion 21 will remain fixed, and flexible member 23 will deform (elastically) to allow the compression member to move towards the platform 3. The anchoring portion 21 may take any suitable shape, for example the anchoring portion 21 may be annular shaped, oval shaped, square shaped, rectangular shaped, square shaped with rounded edges, or rectangular shaped with rounded edges. In this example the anchoring portion 21 is annular shaped. Likewise, the flexible member 23 may take any suitable shape; most preferably the flexible member 23 will have a shape corresponding to the anchoring member and/or compression member 17. In this example the flexible member 23 is annular shaped.

The button assembly further comprises an actuator member 25 which is mounted on the interface member 7 such that it abuts the interface member 7. It should be understood that the actuator member 25 is an optional feature of the present invention. Furthermore, if an actuator member 25 is provided, then it should be understood that it is not essential for the actuator member 25 to be mounted on the interface member 7 such that it abuts the interface member 7, all that is required is that the actuator member 25 can be brought into abutment with the interface member 7 (more specifically all that is required is that the actuator member 25 can be brought into abutment with the compression member 17 of the interface member 7): in another embodiment the actuator member 25 may be positioned above the interface member 7 so that there is a space between the actuator member 25 and the interface member 7, and the actuator member 25 may be selectively pressed to move the actuator member 25 across the space to bring it into abutment with the interface member 7 (more specifically to bring it into abutment with the compression member 17 of the interface member 7).

In this example the actuator member 25 is configured to be attached to, or to abut, the compression member 17; the restrictor member is arranged such that there is a gap 27 between the restrictor member 18 and the actuator member 25. In another embodiment the restrictor member 18 is arranged such that the restrictor member 18 is also attached to, or abuts, the actuator member 25; in other words in this other embodiment there is no gap 27 between the restrictor member 18 and the actuator member 25.

Figure 2A:
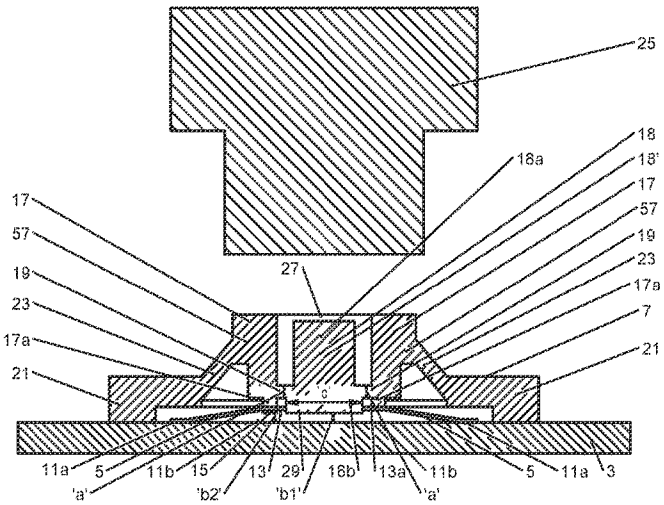
FIGS. 2*a-c* show the various states of the button assembly when a pressing force is applied to the button assembly.
Figure 2C:
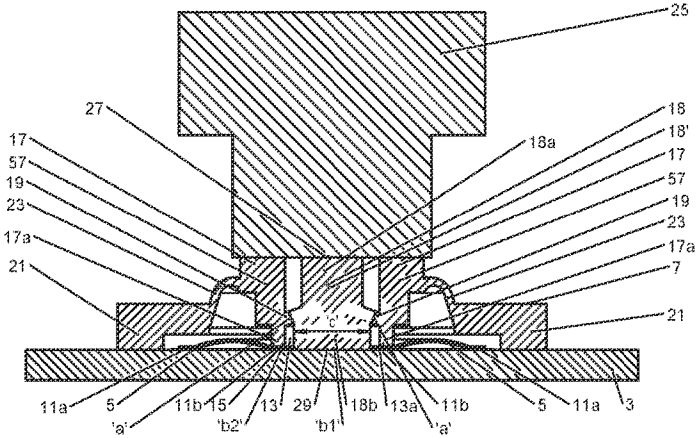
Figure 2B:
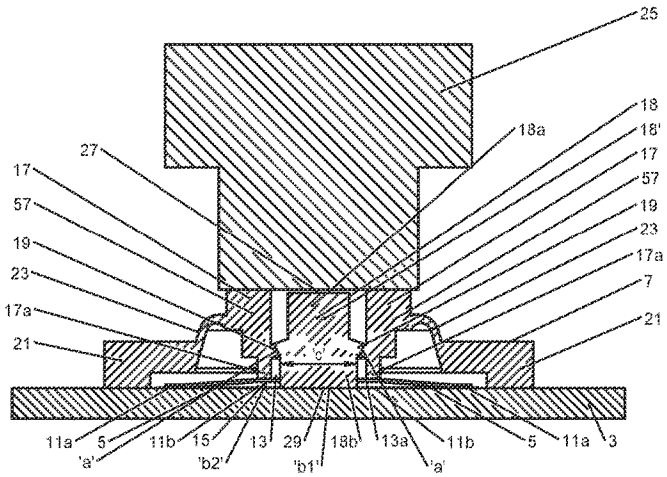

FIGS. 2*a-c* show the various states of the button assembly 1 of FIG. 1 when in use. Specifically FIG. 2*a* illustrates the state of the button assembly 1 before a pressing force is applied to the button assembly 1. FIG. 2*b* illustrates the state of the button assembly 1 when a pressing force is applied to the button assembly 1. FIG. 2*c* illustrates the state of the button assembly 1 after, when in the state illustrated in FIG. 2*b*, continued pressing force is applied to the button assembly 1.

Referring to FIG. 2*a*, no pressing force is applied to the button assembly 1. Accordingly the dome member 5 is in an uncollapsed state (i.e. is not collapsed inwardly), and the portion 15 of the dome member which is adjacent the aperture 13 is removed from the second electrode 11*b* (i.e. does not touch the second electrode 11*b*).

Referring to FIG. 2*b*, a pressing force is applied to the button assembly 1. Specifically a pressing force is applied to the actuator member 25; as the actuator member 25 is pressed it will begin to move in the direction towards the platform 3 and will also force the compression member 17 to move towards the platform 3. The compression member 17 in turn will push the portion 15 of the dome member 5 which is adjacent the aperture 13 towards the second electrode 11*b*.

Additionally, the actuator member 25 move across the gap 27 so that the actuator member 25 is moved towards the restrictor member 18. After the actuator member 25 has been moved across the gap 27 the actuator member 25 will abut the restrictor member 18. Continued application of the pressing force, after the actuator member 25 has abut the restrictor member 18, will now move both the compression member 17 and the restrictor member 18 in the direction of the platform 3.

Since the distance 'b1' (measured in a direction perpendicular to the plane of the platform 3) between the platform 3 and the restrictor member 18 is less than the distance 'b2' (measured in a direction perpendicular to the plane of the platform 3) between the second electrode 11*b* and said portion 15 of the dome member 5 which is adjacent the aperture 13, the restrictor member 18 will abut the platform 3 before the portion 15 of the dome member 5 which is adjacent the aperture 13 is moved by the compression member 17 to a position where it contacts the second electrode 11*b*. When the restrictor member 18 abuts the platform 3, further movement of the restrictor member 18 will be blocked by the platform 3. Consequently, as the pressing force is continued to be applied, the compression member 17 will continue to move towards the platform 3 pushing the portion 15 of the dome member 5 which is adjacent the aperture 13 towards the second electrode 11*b*; since further movement of the restrictor member 18 is blocked by the platform 3 the compression member 17 will move relative to the restrictor member 18, towards the platform 3, thereby stretching the elastic member 19. Additionally, as the pressing force is continued to be applied, the restrictor member 18 will be compressed.

Continued application of the pressing force will cause further stretching the elastic member 19 and will cause the compression member 17 to eventually push the portion 15 of the dome member 5 which is adjacent the aperture 13 towards the second electrode 11*b* a sufficient amount to cause the dome member 5 to collapse inwardly. It should be noted the continued application of force may also cause further compression of the restrictor member 18. FIG. 2*c* illustrates the button assembly 1 after the dome member 5 has collapsed inwardly. When the dome member 5 collapses inwardly the portion 15 of the dome member 5 which is adjacent the aperture 13 will move into electrical contact with the second electrode 11*b*. However, importantly, the stretched elastic member 19 will provide an elastic force in a direction which is opposite to the direction of the inward collapse of the dome member 5; since the portion 15 of the dome member 5 which is adjacent the aperture 13 is attached to the compression member 17, the elastic force of the stretched elastic member 19 is transmitted to the dome member 5; consequently the speed at which the dome member 5 collapses inwardly will be slowed by the elastic force of the stretched elastic member 19 which acts in the opposing direction. Since the speed at which the dome member 15 collapses inwardly is slowed, the noise generated by the button assembly is less than those button assemblies of the prior art; in other words the button assembly of the present invention can provide a quieter operation.

Additionally, the compressed restrictor member 18 will also provide an expansion force in a direction which is opposite to the direction of the inward collapse of the dome member 5; thus the speed at which the dome member 15 collapses inwardly is slowed even further by the expansion force which results from the compression of the restrictor member 18 against the platform 3.

Figure 3A:
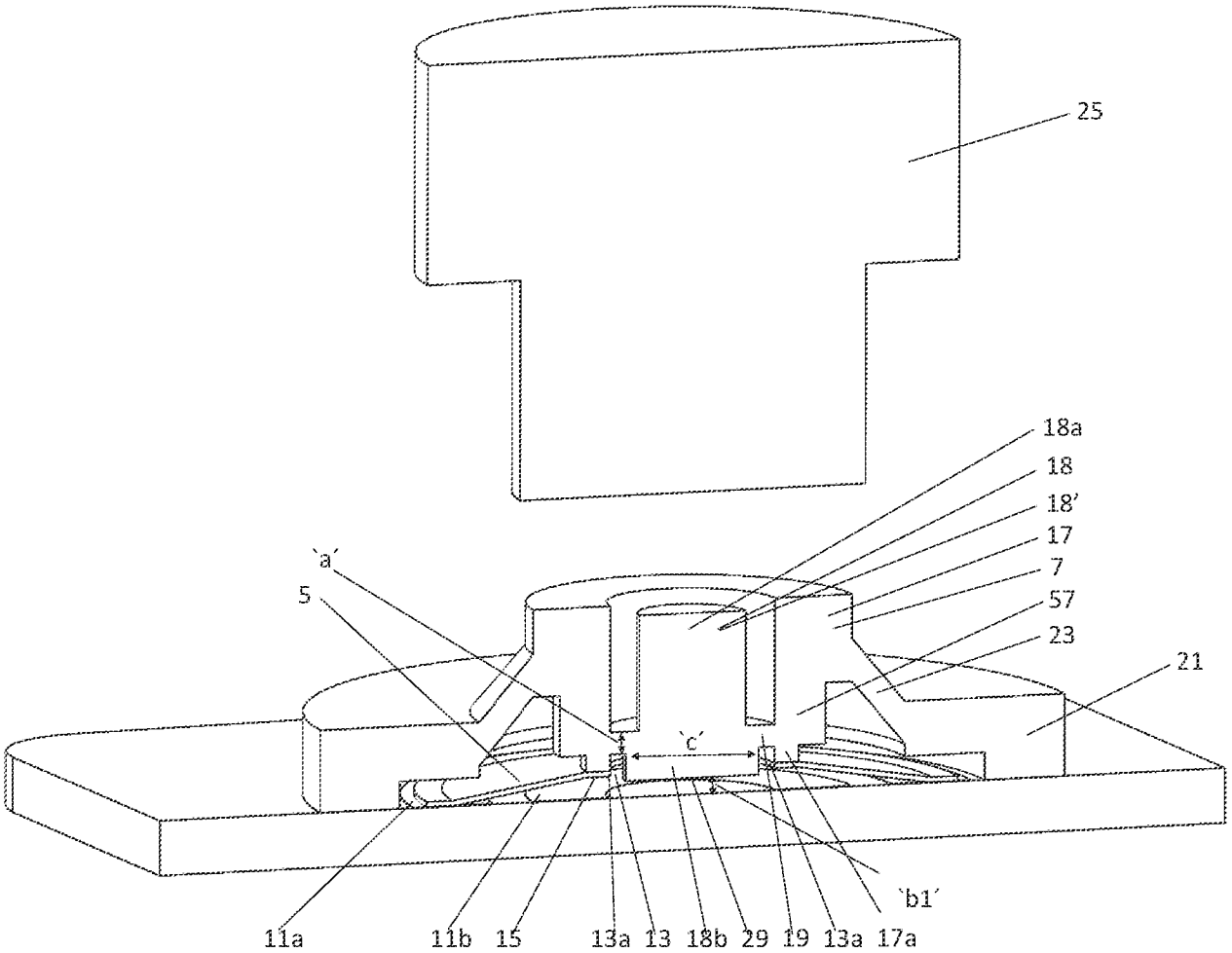
FIGS. 3*a* and 3*b* provide perspective, cross-sectional, views of the button assembly of FIG. 1.
Figure 3B:
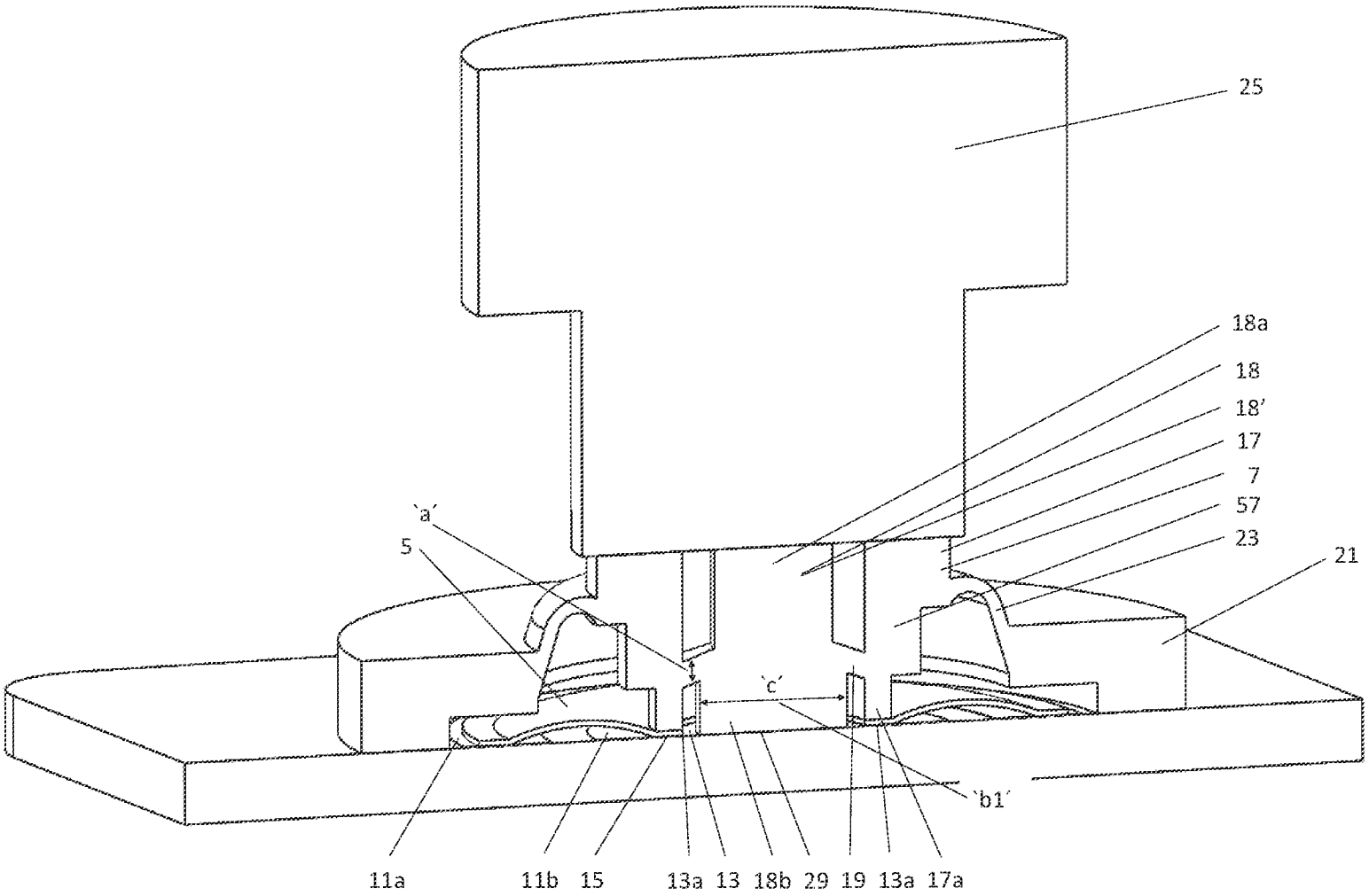

FIGS. 3*a* and 3*b* provide perspective, cross-sectional, views of the button assembly of FIG. 1. Specifically, FIG. 3*a* illustrates the button assembly prior to the application of force to the actuator member i.e. a perspective, cross-sectional, view of the button assembly when in the state illustrated in FIG. 2*a*; in FIG. 3*a*, for clarity, the actuator member 25 is shown removed from the interface member 7 so as to allow for a clearer view of the interface member 7. FIG. 3*b* illustrates the button assemble after force has been applied to the actuator member to cause the dome member to collapse inwardly i.e. a perspective, cross-sectional, view of the button assembly when in the state illustrated in FIG. 2*c*.

Figure 4:
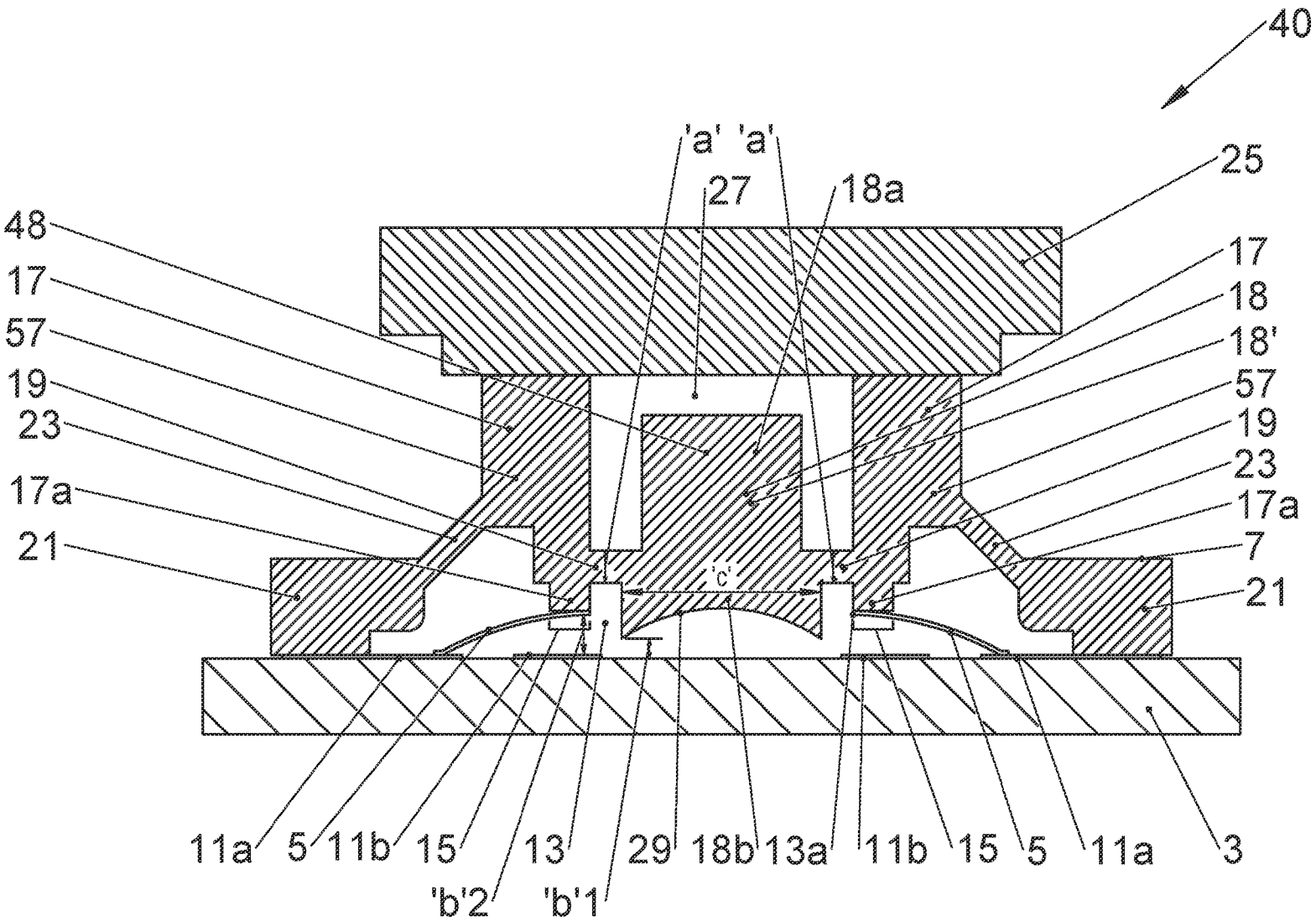
FIG. 4 shows a cross-sectional view of a button assembly according to further embodiment of the present invention.

FIG. 4 shows a cross-sectional view of a button assembly 40 according to further embodiment of the present invention. The button assembly 40 has many of the same features as the button assembly 1 shown in FIG. 1 and like features are awarded the same reference numbers.

The button assembly 40 comprises the restrictor member 48 comprises a first portion 18*a* which extends, from the level where the elastic member 19 connects to the restrictor member 48, away from the platform 3; and second portion 18*b* which extends, from the level where the elastic member 19 connects to the restrictor member, towards the platform 3. As already described above, the first portion 18*a* and second portion 18*b* may take any suitable shape such as, for example, cube-shaped, cuboid-shaped, frustoconical-shaped, a form having opposing elliptical-shaped surfaces such as a substantially cylindrical-shape having opposing elliptical-shaped surfaces. The surface 29 which faces towards the platform 3, can therefore any suitable shape, such as, for example square-shape, rectangular-shape, circular-shape, elliptical-shape etc.

Importantly, in the button assembly 40, a surface 29 of the second portion 18*b* which faces towards the platform 3, is configured to be curved. Specifically, the surface 29 which faces towards the platform 3, has a concave, flat or convex shape. In this example the surface 29 which faces towards the platform 3, has a concave, shape; most preferable the surface 29 is bowl-shaped or inverted-bowl-shaped. Preferably the surface 29 is configured to have a radius of curvature within the range 5.0 mm-12.0 mm. Most preferably the surface 29 is configured to have a radius of curvature of 10.0 mm.

Advantageously, the curved surface 29 provided in the button assembly 40, will provide for a desired sound when the dome member 5 collapses inwardly.

Figure 5:
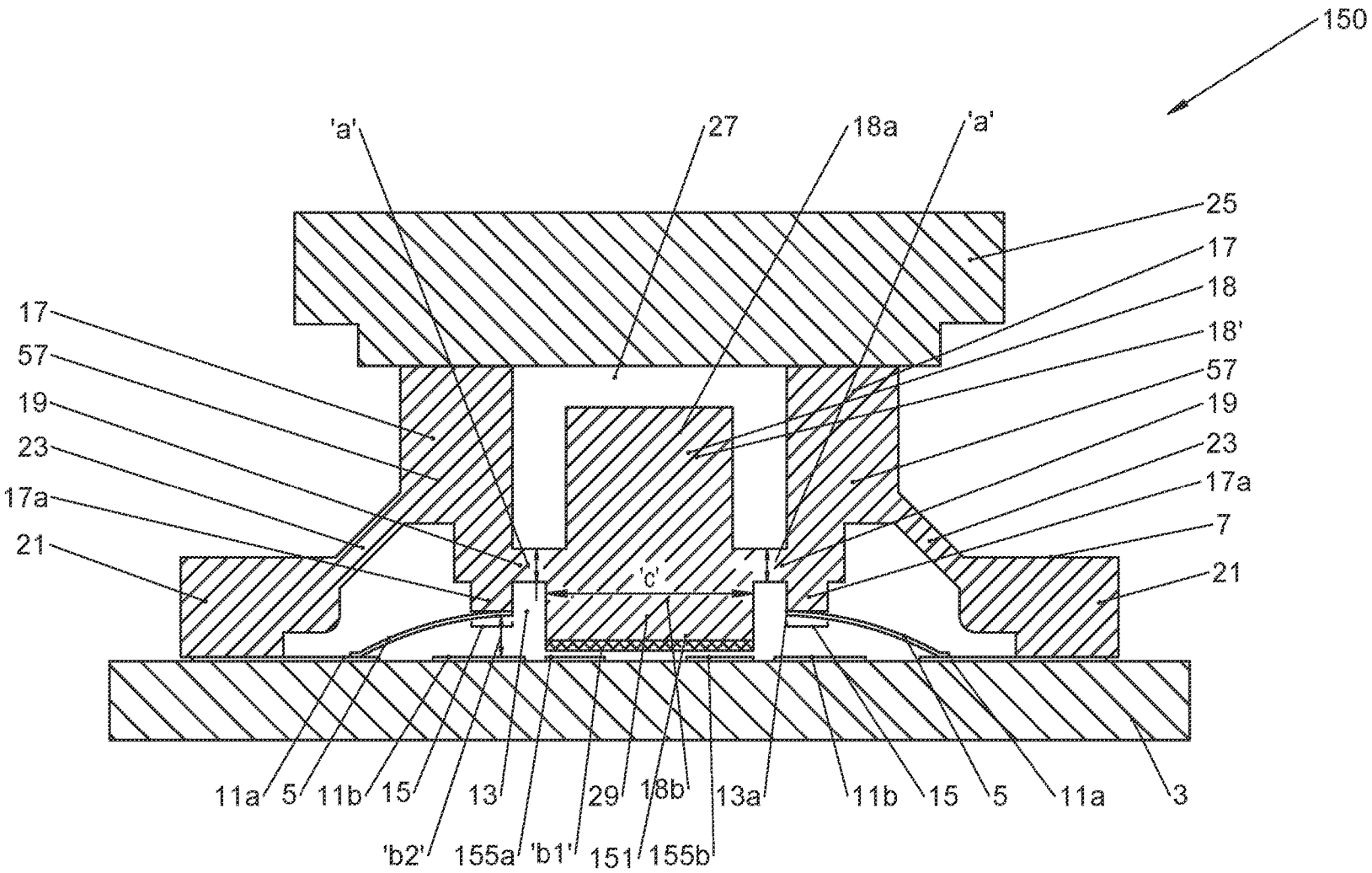
FIG. 5 shows a cross-sectional view of a button assembly according to further embodiment of the present invention.

FIG. 5 shows a cross-sectional view of a button assembly 150 according to further embodiment of the present invention. The button assembly 150 has many of the same features as the button assembly 1 shown in FIG. 1 and like features are awarded the same reference numbers.

In the button assembly 150 an electrical contact 151 is attached to the surface 29 of the second portion 18*b* of the restrictor member 18. The electrical contact 151 may comprise any suitable electrically conducting material; for example electrical contact 151 may comprise any one or more or, carbon, silicone having carbon particles, metal (such as gold, copper, silver, nickel, brass), the electrical contact 151 may comprises metal blank or a substrate plated with metal such as gold, tin or nickel (e.g. 2-Sum thickness) or gold (e.g. 50-200 nm thickness) for example. In one embodiment the electrical contact 151 comprises a metallic disk. In another embodiment the electrical contact 151 comprises electrically conducting wires.

In the button assembly 150 the platform 3 further comprises a third and fourth electrode 155*a*, 155*b*. The electrical contact 151 (which is attached to the surface 29 of the second portion 18*b* of the restrictor member 18) overlays at least a part of each of the third and fourth electrodes 155*a*,155*b*. Accordingly, during use, the restrictor member 18 is moved towards the platform 3, so as to bring the electrical contact 151 into physical and electrical contact with the third and fourth electrodes 155*a*, 155*b*; the electrical contact 151 will therefore electrically connect the third and fourth electrodes 155*a*, 155*b*. Preferably the distance 'b1' (measured in a direction perpendicular to the plane of the platform 3) between the electrical contact 151 and each of the third and fourth electrodes 155*a*,155*b* is within the range 0.05 mm-0.5 mm. The third and fourth electrodes 155*a*, 155*b* may be part of an electrical circuit (such as an electrical circuit in a automobile for opening and closing a window in the automobile) and the electrical connection between the third and fourth electrodes 155*a*, 155*b* provided by the electrical contact 151 on the restrictor member 18, may close that electrical circuit; the closing of the electrical circuit may result in a predefined actuation (such as the closing of the window of a car). Thus in the button assembly 150, by applying a pressing force to the button assembly 150 the restrictor member 18 is moved towards the platform 3; the electrical contact 151 on the restrictor member 18 will moved to abut the third and fourth electrode 155*a*,155*b* so as to electrically connect the third and fourth electrode 155*a*, 155*b*; continued pressing of the button assembly will then cause the dome member 5 collapses inwardly so that the portion 15 of the dome member 5 which is adjacent the aperture 13 will move into electrical contact with the second electrode 11*b* so that the dome member 5 electrically connects the first and second electrode 11*a*,11*b*. Accordingly, the electrical contact 151 on the restrictor member 18 will electrically connect the third and fourth electrodes 155*a*, 155*b* and the dome member 5 will electrically connect the first and second electrodes 11*a*,11*b*. It should be understood that the third and fourth electrodes 155*a*,155*b* may be part of a first electrical circuit and the first and second electrodes 11*a*,11*b* may part of a second, different, electrical circuit; or in another embodiment the third and fourth electrodes 155*a*,155*b* and the first and second electrodes 11*a*,11*b* are part of the same electrical circuit.

Figure 10:
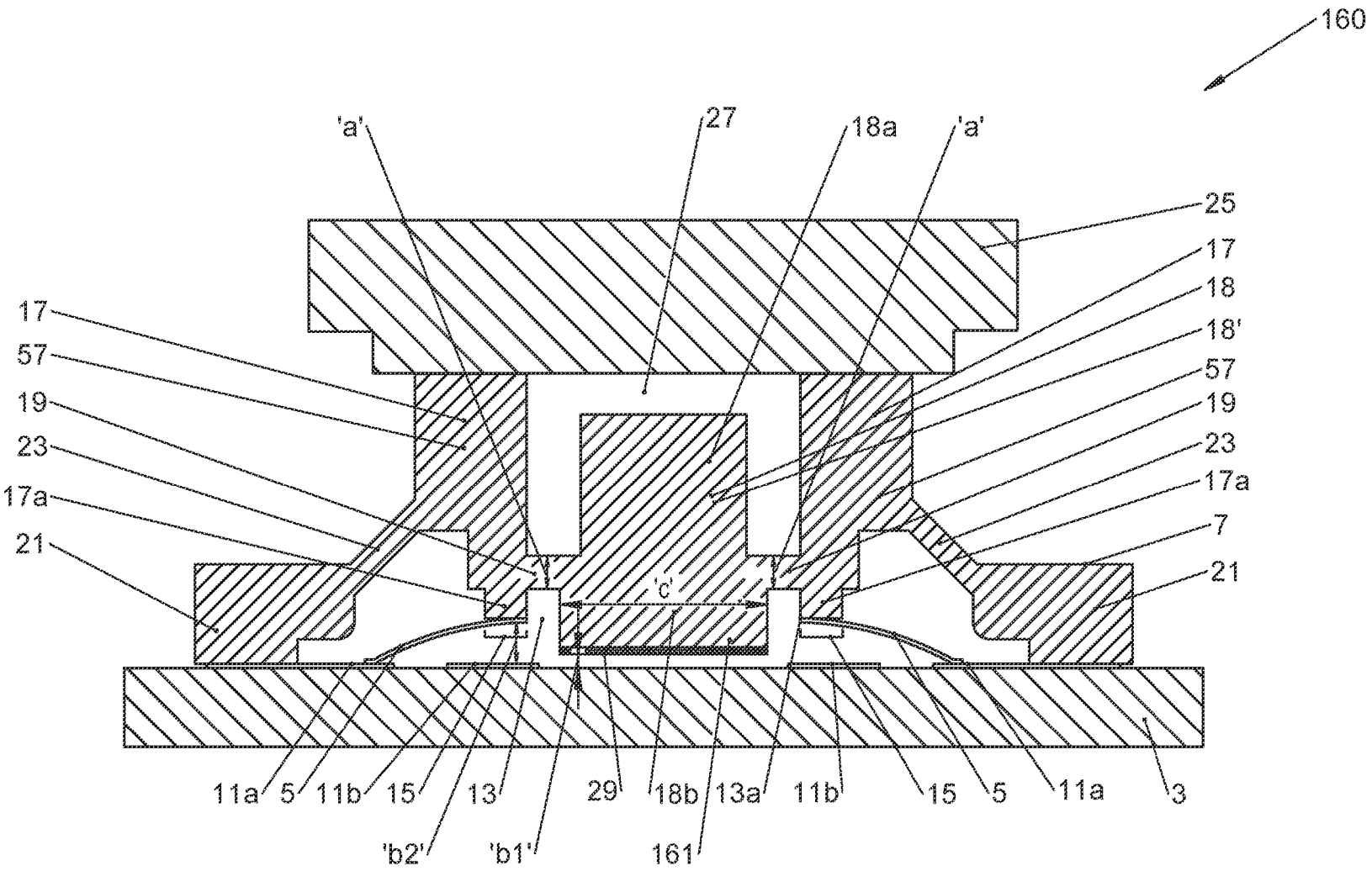
FIG. 10 shows a cross-sectional view of a button assembly according to further embodiment of the present invention.

FIG. 10 provides a cross sectional view of a button assembly 160 according to a further embodiment of the present invention. The button assembly 160 has many of the same features as the button assembly 1 shown in FIG. 1 and like features are awarded the same reference numbers. The button assembly 160 further comprises damper member 161 which is attached to the surface 29 of the second portion 18*b* of the restrictor member 18 (it will be understood that the restrictor member 18 may have any shape; and that the damper member 161 will be attached to the surface 29 of the restrictor member 18 which is facing the platform regardless of the shape of the restrictor member 18). In this embodiment the damper member is defined simply by a block of suitable material which is attached to the surface 29 of the second portion 18*b* of the restrictor member 18. It will be understood that the damper member 161 may take any suitable form, for example, in other embodiments the damper member 161 may be defined by one more nodules of suitable material, or layer of suitable material, or a film of suitable material, which is/are provided on the surface 29 of the restrictor member 18. The damper member 161 may comprise any suitable material; for example damper member 161 may comprise any one or more or, carbon, silicone having carbon particles, silicone having metal particles (such as gold, copper, silver, nickel, brass), or silicone having organic or inorganic particles (such as ceramics, silica), or any other suitable material composition. Preferably the distance 'b1' (measured in a direction perpendicular to the plane of the platform 3) between the damper member 161 and the platform 3 is within the range 0.05 mm-0.5 mm. When the restrictor member is moved towards the platform, the damper member 161 will contact platform 3; due to the material composition of the damper member 161 less noise will be created upon contact of the damper member 161 with the platform 3 compared to if the surface 29 were to directly contact the platform 3; thus the button assembly 160 of FIG. 10 can achieve an even quieter operation.

Figure 6:
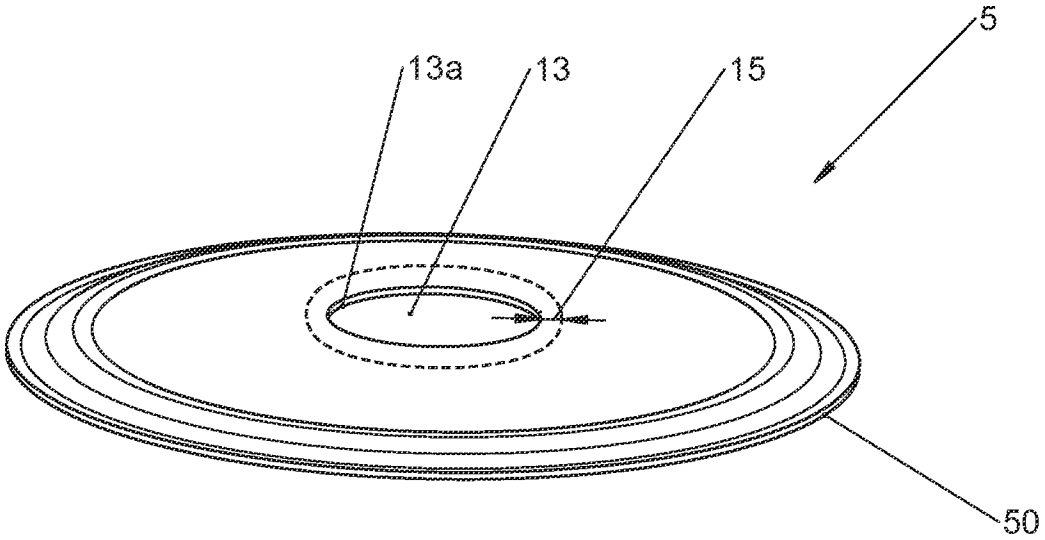
FIGS. 6 and 7 provide perspective views of two possible configurations for the dome member which could be used in any of the button assembly embodiment.
Figure 7:
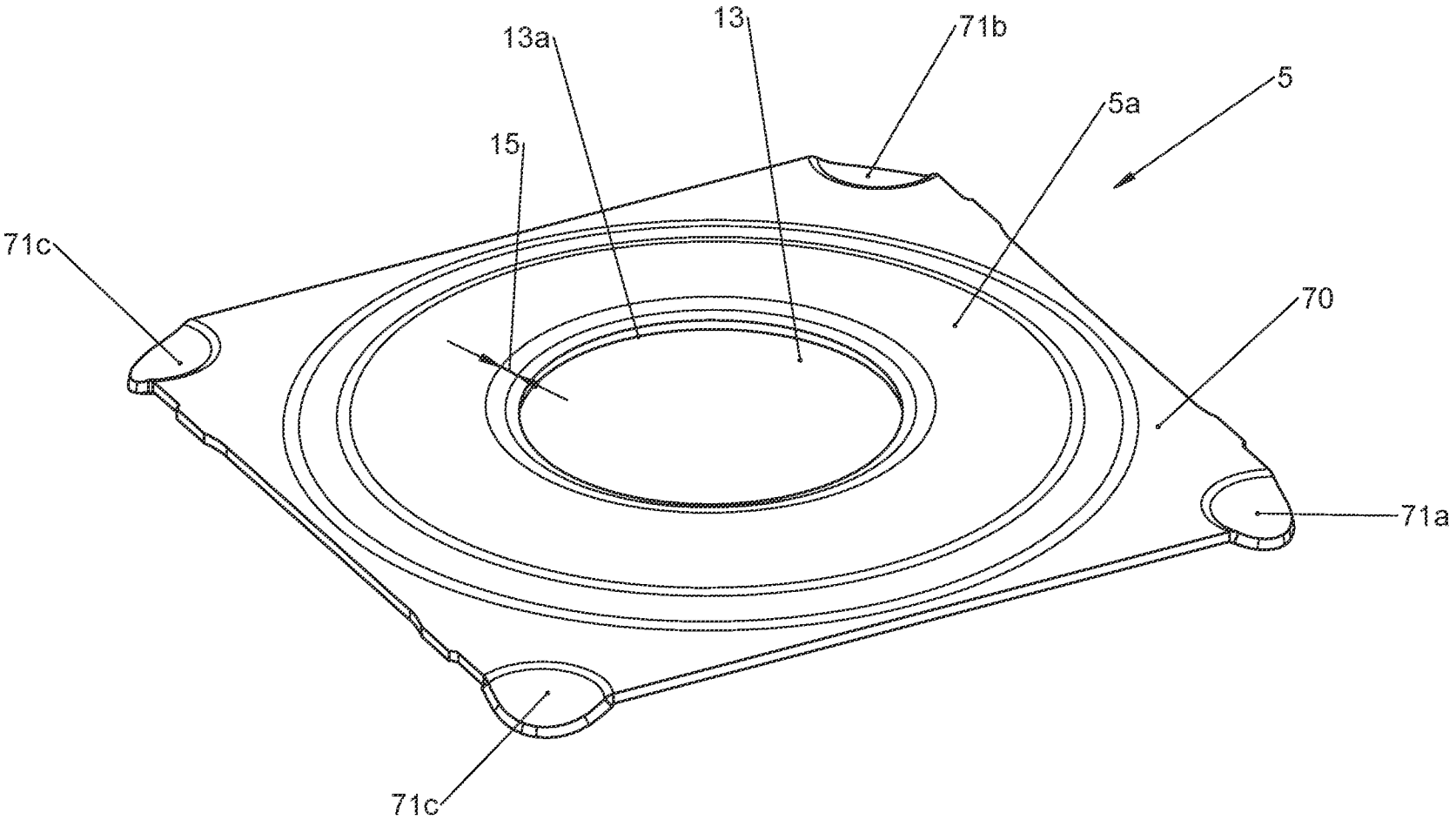

As already mention the dome member 5 used in the button assembly of the present invention may take any suitable form. FIGS. 6 and 7 provide a perspective view of two possible configurations for the dome member which could be used in any of the button assembly embodiments of the present invention.

FIG. 6 illustrates a dome member 5 which has an aperture 13 defined therein at its centre (a rim 13*a* defines the aperture 13). In this embodiment since the dome member 5 has an aperture defined at its centre, the dome member has a truncated-dome-shape. The dome member 5 has an outer rim 50. When used in the button assembly of the present invention, typically the dome member 5 is arranged to be mounted on the first electrode 11*a* so that the outer rim 50 of the dome member physically and electrically contacts the first electrode 11*a*. The portion 15 of the dome member 5 which is adjacent the aperture 13 (more specifically the portion 15 of the dome member 5 which is adjacent the rim 13*a* which defines the aperture 13) will overlay at least a portion of the second electrode 11*b* in the button assembly, so that the dome member 5 can be selectively collapsed inwardly by the application of force, to bring the portion 15 of the dome member which is adjacent the aperture 13 into electrical contact with the second electrode 11*b*.

FIG. 7 provides a perspective view another possible configuration for the dome member 5. The dome member 5 comprises a dome-shaped portion 5*a* having an aperture 13 defined therein at its centre (a rim 13*a* defines the aperture 13). The dome member 5 further comprises a quadrilateral base portion 70 (i.e. a base which is quadrilateral shaped). The quadrilateral base portion 70 is planar (or substantially planar), and the dome-shaped portion 5*a* extends from the quadrilateral base portion 70. In this example quadrilateral base portion 70 has rounded edges; more specifically in this example quadrilateral base portion 70 has a square shaped perimeter having rounded edges. The quadrilateral base portion 70 comprises leg members 71*a-d* at each of its four corners. It should be understood that the quadrilateral base portion 70 may comprise any number of leg members, and the leg members may be located at any suitable position on the quadrilateral base portion 70. Each of the leg members 71*a-d* extend in a direction opposite to the direction in which the dome-shaped portion 5*a* extends from the quadrilateral base portion 70. When used in the button assembly of the present invention, typically the dome member S is arranged to be mounted on the first electrode 11*a* so that each of the four leg members 71*a-d* of the dome member physically and electrically contact the first electrode 11*a*. The portion 15 of the dome member 5 which is adjacent the aperture 13 (more specifically the portion 15 of the dome member 5 which is adjacent the rim 13*a* which defines the aperture 13) will overlay at least a portion of the second electrode 11*b* in the button assembly, so that the dome-shaped portion 5*a* of the dome member 5 can be selectively collapsed inwardly by the application of force, to bring the portion 15 of the dome member 5 which is adjacent the aperture 13 into electrical contact with the second electrode 11*b*.

As will be described later, in yet further embodiments of the button assembly according to the present invention, the dome member 5 does not comprise any aperture 13; in such embodiments the dome member 5 make take either of the forms shown in FIG. 6 or 7, but without the aperture 13.

Figure 8A:
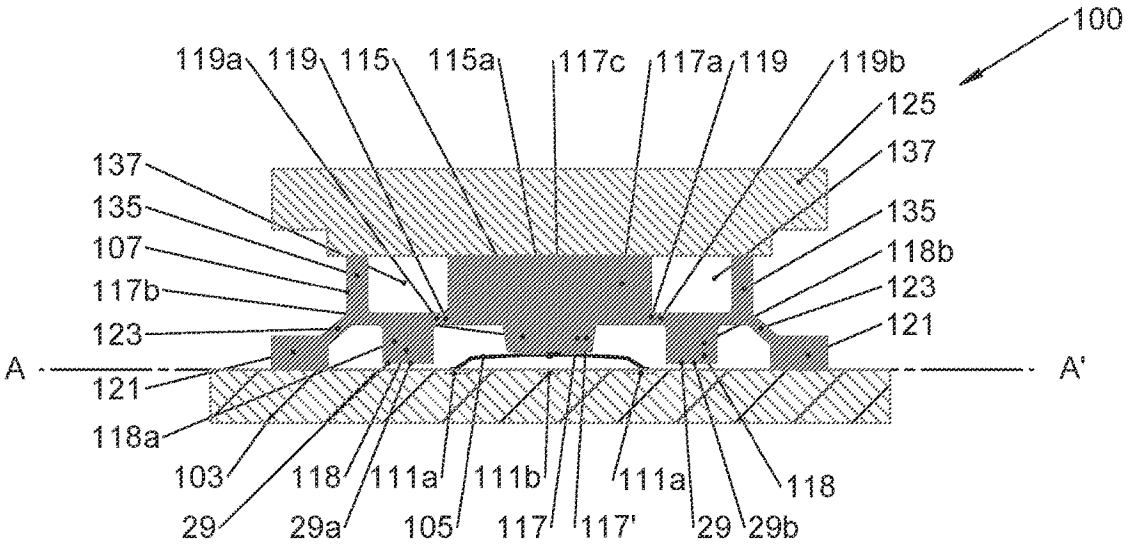
FIG. 8*a* shows a cross-sectional view of the button assembly according to further embodiment of the present invention.
Figure 8B:
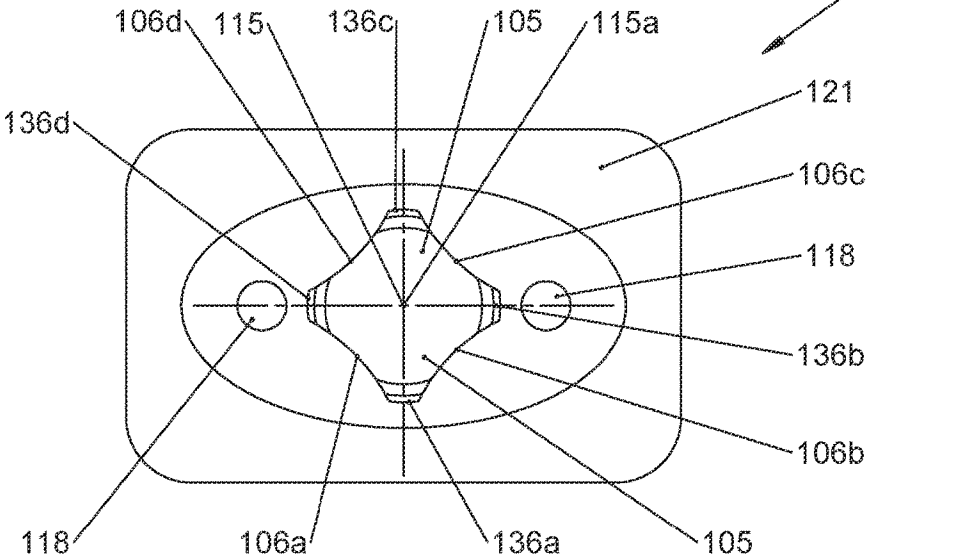
FIG. 8*b* shows a transverse view of the button assembly of FIG. 8*a* taken along line A-A' of FIG. 8*a;*

FIG. 8*a* shows a cross-sectional view of the button assembly 100 according to a further embodiment of the present invention. FIG. 8*b* shows a transverse view of the button assembly 100.

Referring to FIGS. 8*a* and 8*b* the button assembly 100, comprises, a platform 103, a dome member 105, an interface member 107 and, optionally, an actuator member 125.

The platform 103 is preferably a printed circuit board (PCB). The platform is has at least a first electrode 111*a* and a second electrode 111*b*, wherein the first and second electrodes are insulated from one another. In this example each of the first electrode 111*a* is annular shaped and the second electrode 111*b* is disk-shaped. In this example the second electrode 111*b* is contained within an area defined by the annular-shaped first electrode 111*a*. However it should be understood that the first electrode 111*a* and the second electrode 111*b* may take any suitable shape of configuration.

The dome member 105 comprises electrically conductive material (e.g. stainless steel, copper, nickel plated, gold plated, silver plated). Unlike the previous embodiment illustrated in FIG. 1, the dome member 105 does not have an aperture defined at its centre. Accordingly in this embodiment the dome member 105 comprises an apex 115*a*.

The dome member 105 is electrically connected to the first electrode 111*a*. In this example dome member 105 comprises a dome shaped portion 105 having at least four arched cut-outs 106*a-d*, so as to define at least four leg portions 136*a-d*. Each of the four leg portions 136*a-d* are positioned so that they rest on the first electrode 111*a*, so that the dome member 105 physically and electrically contacts the first electrode 111*a*.

It will be understood that the dome member 105 may take any suitable configuration. In another embodiment the dome member 105 does not comprise any arched cut-outs 106*a-d*. It should be understood that the dome member 105 may have any of the features of the dome member 5 used in the previously described embodiments. For example, in one embodiment the dome member 105 may optionally comprise a dome shaped portion, which does not have an aperture defined at its centre, and which is attached to a quadrilateral base portion (e.g. the quadrilateral base portion 70 shown in FIG. 7).

Referring back to the button assembly 100 embodiment shown in FIGS. 8*a,b*, the dome member 105 is arranged so that a centre portion 115 of the dome member 105 overlays at least a portion of the second electrode 111*b*, so that the dome member 5 can be selectively collapsed inwardly by the application of force to bring the centre portion 115 of the dome member 105 into electrical contact with the second electrode 111*b*. In this example the centre portion 115 is defined by the apex 115*a* of the dome member 105; in other words in this example the dome member 105 is arranged so that the apex 115*a* of the dome member 105 overlays the second electrode 111*b*. Accordingly, in its collapse state the dome member 105 electrically connects the first electrode 111*a* and a second electrode 111*b*. Most preferably when the dome member 105 electrically connects the first electrode 111*a* and a second electrode 111*b* this connection will close a circuit, and will result in some predefined actuation taking place (e.g. the closing of an electrically controlled window in a car). In the most preferred embodiment the second electrode 111*b* is disk-shaped and the dome member 105 is arranged so that the apex 115*a* of the dome member 105 is aligned with the centre of the disk-shaped second electrode 111*b*.

The interface member 107 comprises, a compression member 117, a restrictor member 118 and at least one elastic member 119.

The interface member 107 is composed of material having a Young's Modulus within the range 0.9 N/mm2-6.0 N/mm2, corresponding to a hardness of between 30° ShoreA-80° Shore A. Most preferably the interface member 107 is composed of material having a Young's Modulus of 3.0 N/mm2, corresponding to a hardness of 60° ShoreA. In this example the interface member 107 is composed of silicone material; however it will be understood that the interface member 7 could be composed of any other suitable material; preferably the material is an elastomer. In this example the interface member 107 is formed from a single moulded piece, thus the compression member 107, a restrictor member 118 and the at least one elastic member 119, are simply different parts of that single moulded piece. However, it should be understood that the interface member 107 is not limited to being a single moulded piece; the compression member 117, a restrictor member 118 and the at least one elastic member 119, could be formed from different respective pieces which are attached to one another using a suitable means of attachment.

The compression member 117 is attached to said centre portion 115 of the dome member 105. Specifically, the compression member 117 is attached to the apex 115*a* of the dome member 105.

It will be understood that the compression member 117 may take any suitable configuration. In this example the compression member 117 comprises a block 117', having a first portion 117*a* and a second portion 117*b*. The first portion 117*a* and a second portion 117*b* may have any suitable shape, form or configuration. In this example the first portion 117*a* comprises a cylindrical portion 117*a* and the second portion 117*b* comprises a fustoconical portion 117*b*. In this embodiment the fustoconical portion 117*b* of the compression member 117 is attached to said centre portion 115 of the dome member 105 i.e. the fustoconical portion 117*b* of the compression member 117 is attached to the apex 115*a* of the dome member 105. Specifically, the circular surface 117*c* of the fustoconical portion 117*b* which has the shortest diameter, is attached to said centre portion 115 (apex 115*a*) of the dome member 105.

The compression member 117 may have any suitable dimensions; in this example the cylindrical portion 117*a* which has a cross section having a diameter in the range 3.0 mm-10.0 mm and the fustoconical portion 117*b* which has a cross section having a diameter in the range 3.0 mm-8.0 mm.

The restrictor member 118 is arranged to project towards the platform 3. The distance 'b1' (measured in a direction perpendicular to the plane of the platform 3) between the platform 103 and the restrictor member 118 is less than the distance 'b2' (measured in a direction perpendicular to the plane of the platform 103) between the second electrode 111*b* and said centre portion 115 of the dome member 105. In this example, the restrictor member 118 comprises one or more surfaces 29 which face the platform 3, and the distance 'b1' (measured in a direction perpendicular to the plane of the platform 3) is the distance between the platform 103 and the surface 29 of the restrictor member 118.

It will be understood that the restrictor member 118 may take any suitable configuration. In this example the restrictor member 118 is defined by at least one pillar member; specifically in this example the restrictor member 118 is defined by two pillar members 118*a*, 118*b*. The two pillar members 118*a*, 118*b* may have any suitable dimensions; in this example each of the two pillar members 118*a*, 118*b* are cylindrical shaped; and most preferably each of the two pillar member 118*a*,118*b* have a cross section which has a cross section having a diameter of 2.0 mm. Each of the two pillar members 118*a*,118*b* will comprise a respective surface 29*a*,29*b* which face the platform 3.

The two pillar members 118*a*,118*b* are positioned symmetrically with respect to the dome member 105. Specifically the two pillar members 118*a*, 118*b* are positioned at opposite sides of the dome member 105. In this example, each of the two pillar members 118*a*, 118*b* are cylindrical shaped. Accordingly the respective surfaces 29*a*,29*b* of the two pillar members 118*a*, 118*b* will each be circular shaped. However it will be understood that the two pillar members 118*a*, 118*b* make take any suitable shape or configuration. For example each of the two pillar members may be cube-shaped, cuboid-shaped, frustoconical-shaped; may be a form having opposing elliptical-shaped surfaces such as a substantially cylindrical-shape having opposing elliptical-shaped surfaces. The shape of the pillar members 118*a*,118*b* will determine the shape 29 of the surface 29*a*,29*b*. For example the two pillar members 118*a*, 118*b* may each be cube-shaped resulting in the surfaces 29*a*29*b* each being square shaped; the two pillar members 118*a*, 118*b* may each be cuboid-shaped resulting in the surfaces 29*a*29*b* each being rectangular or square shaped; the two pillar members 118*a*, 118*b* may each be frustoconical-shaped resulting in the surfaces 29*a*29*b* each being circular shaped; in yet another example the two pillar members 118*a*, 118*b* may each be in a form having opposing elliptical-shaped surfaces resulting in the surfaces 29*a*29*b* each being elliptical shaped, for example the two pillar members 118*a*, 118*b* may each be substantially cylindrical-shape having opposing elliptical-shaped surfaces, resulting in the surfaces 29*a*29*b* each being elliptical shaped. The shape of the surfaces 29*a*,29*b* will influence the sound made when the dome member 105 collapses inwardly.

It should also be understood that the restrictor member 118 may comprise any number of pillar members. Most preferably the pillar members will be arranged symmetrically with respect to one another. So, for example, it the restrictor member 118 comprises three pillar members then the three pillar members will be positioned 120° apart; if the restrictor member 118 comprises four pillar members then the four pillar members will be positioned 90° apart. In yet a further embodiment the restrictor member 118 comprises and annular member which is arranged around the compression member 117.

As mentioned the interface member 117 comprises at least one elastic member 119. In this example interface member 117 comprises a two elastic members, a first elastic member 119*a* and a second elastic member 119*b*. The elastic member 119 connects the restrictor member 118 to the compression member 117; specifically in this example the first elastic member 119*a* connects the one pillar member 118*a* to the compression member 117 and the second elastic member 119*b* connects the other pillar member 118*b* to the compression member 117. Thus the first elastic member 119*a* is interposed between one pillar member 118*a* and the compression member 117, and the second elastic member 119*b* is interposed between the other pillar member 118*b* and the compression member 117. Since each of the first and second elastic members 119*a*,119*b* are elastic, they can each stretch to allow compression member 117 to be moved with respect to the respective pillar members 118*a*,118*b*.

The first and second elastic members 119*a,b* each preferably has a thickness "a" (measured in a direction perpendicular to the plane of the platform 3) within the range 0.15 mm-0.8 mm. Most preferably each of the first and second elastic members 119*a,b* has a thickness "a" (measured in a direction perpendicular to the plane of the platform 3 of 0.4 mm.

The interface member 107 further comprise an anchoring portion 121. The anchoring portion 121 is fixed, directly or indirectly, to the platform 103. In this example the anchoring portion 121 is fixed to first electrode 111*a* on the platform 103, so that anchoring portion 121 is fixed indirectly to the platform 103.

The interface member 117 comprises a wall member 135 which is arranged to surround the first portion 117*a* of the compression member 117. A flexible member 123 connects the anchoring portion 121 to the wall member 135. A channel 137 is defined between the wall member 135 and the first portion 117*a* of the compression member 117. Each of the first and second pillar members 118*a*,118*b* are located opposite to, and are aligned with, the channel 137; and each of the first and second pillar members 118*a*,118*b* project in a direction away from the channel 137 towards the platform 103.

The anchoring portion 121 may take any suitable shaped, for example the anchoring portion 21 may be annular shaped, oval shaped, square shaped, rectangular shaped, square shaped with rounded edges, or rectangular shaped with rounded edges. In this example, as can be seen from FIG. 8*b*, the anchoring portion 121 is rectangular shaped with rounded edge.

The button assembly 100 further comprises an actuator member 125 which is mounted on the interface member 107. In this example the actuator member 125 is configured to be attached to, or to abut, both the compression member 117 and the restrictor member 118.

The button assembly 100 operates in a similar fashion to the button assembly 100 of FIG. 1.

Figure 9A:
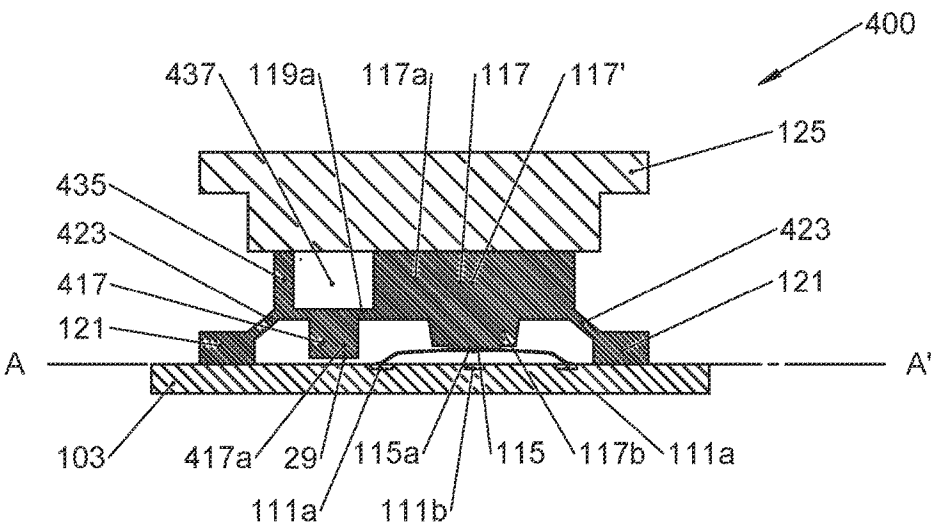
FIG. 9 shows a cross-sectional view of the button assembly according to further embodiment of the present invention.
FIG. 9*b* shows a transverse view of the button assembly of FIG. 9*a* taken along line A-A' of FIG. 9*a;*
Figure 9B:
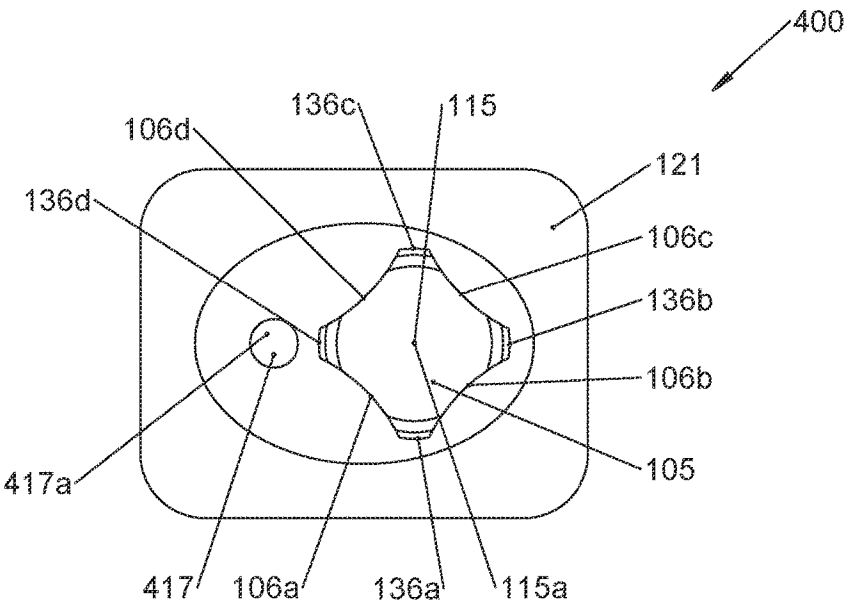

FIG. 9*a* shows a cross-sectional view of the button assembly 400 according to a further embodiment of the present invention. FIG. 9*b* shows a transverse view of the button assembly 400.

The button assembly 400 has many of the same features as the button assembly 100 shown in FIGS. 8*a* and 8*b* and like features are awarded the same reference numbers. However the button assembly 400 comprises a compression member 417 which comprises a single pillar member 417*a* only.

In this example, single pillar member 417*a* is cylindrical shaped. Accordingly the surface 29 of the single pillar member 417 which is facing the platform 103 will be circular shaped. However it will be understood that the single pillar member 417*a* make take any suitable shape or configuration. For example the single pillar member 417*a* may be cube-shaped, cuboid-shaped, frustoconical-shaped; may be a form having opposing elliptical-shaped surfaces such as a substantially cylindrical-shape having opposing elliptical-shaped surfaces. The shape of the single pillar member 417*a* will dictate the shape of the surface 29 which faces the platform 103.

The interface member 117 comprises a single elastic member 119*a*. The single elastic member 119*a* connects the single pillar member 417*a* to the compression member 117. Thus the single elastic member 119*a* is interposed between the single pillar member 417*a* and the compression member 117. Since each of the single elastic member 119*a* is elastic, it can each stretch to allow compression member 117 to be moved with respect to the single elastic member 119*a*. The single elastic member 119*a* preferably has a thickness "a" (measured in a direction perpendicular to the plane of the platform 3) within the range of 0.15 mm-0.8 mm. Most preferably the single elastic member 119*a* has a thickness "a" (measured in a direction perpendicular to the plane of the platform 3) of 0.4 mm.

The interface member 107 comprises an anchoring portion 121. The anchoring portion 121 is fixed to the platform 103. The interface member 417 comprises a wall member 435 and a channel 437 is defined between the wall member 435 and the cylindrical portion 117*a* of the compression member 117. The single pillar member 417 is located opposite to, and are aligned with, the channel 437; and single pillar member 417 projects away from the channel 437 towards the platform 103.

A flexible member 423 connects the anchoring portion 121 to the wall member 435 and connects the anchoring portion 121 to the compression member 117.

The button assembly 400 operates in a similar fashion to the button assembly 100 of FIG. 1.

Various modifications and variations to the described embodiments of the invention will be apparent to those skilled in the art without departing from the scope of the invention as defined in the appended claims. Although the invention has been described in connection with specific preferred embodiments, it should be understood that the invention as claimed should not be unduly limited to such specific embodiment.

The invention claimed is:

1. A button assembly comprising;

an actuator member;

a platform including at least first and second electrodes;

an electrically conductive dome member; and an interface member further comprising;

a compression member;

an anchoring portion; and a restrictor member; wherein the restrictor member is suspended above the platform from the compression member by an elastic member such that there is a gap between the restrictor member and the actuator member.

2. A button assembly according to claim 1 wherein the second electrode is annular shaped.

3. A button assembly according to claim 1 wherein said compression member comprises two or more nodules which are located symmetrically with respect to one another; and wherein said two or more nodules are each attached to the portion of the dome member which overlays said second electrode.

4. A button assembly according to claim 1 wherein said compression member comprises an annular rim; wherein the annular rim is attached to the portion of the dome member which overlays said second electrode.

5. A button assembly according to claim 1 wherein the restrictor member comprises a surface which faces the platform, and wherein there is a distance between the platform and the surface, whereupon application of a pressing force to the actuator member, said surface of the restrictor member abuts the platform to provide a first tactile feedback, before any portion of the dome member which overlays the second electrode is moved by the compression member to a position where the dome member contacts the second electrode wherein the contact between the dome member and the second electrode provides a second tactile feedback.

6. A button assembly according to claim 1 wherein the dome member comprises an apex; and wherein the dome member is arranged so that the apex of dome member overlays at least a portion of the second electrode.

7. A button assembly according to claim 6 wherein the second electrode is disk-shaped and the dome member is arranged so that the apex of dome member is aligned with the centre of the disk-shaped second electrode.

8. A button assembly according to claim 6 wherein the compression member comprises a block member which is attached to the apex of the dome member.

9. A button assembly according to claim 1 wherein the restrictor member comprises a block member having first and second portions.

10. A button assembly according to claim 9 wherein the dome member has an aperture defined therein and wherein the second portion of the restrictor member extends through the aperture towards the platform.

11. A button assembly according to claim 9 wherein the first portion defines a first pillar member and the second portion defines a second pillar member.

12. A button assembly according to claim 11 wherein the first and second pillar members are arranged symmetrically with respect to one another.

13. A button assembly according to claim 9 wherein the second portion of the block member has a surface which faces the platform.

14. A button assembly according to claim 13 wherein said surface has a circular-shaped perimeter, a square-shaped perimeter, a rectangular-shaped perimeter, or an elliptical-shaped perimeter.

15. A button assembly according to claim 13 wherein said surface is concave or convex.

16. A button assembly according to claim 13 wherein an electrical contact is attached said surface.

17. A button assembly according to claim 13 wherein a damper member is attached said surface.

* * * * *